United States Patent [19]

Kopin

[11] 4,171,011

[45] Oct. 16, 1979

[54] HANDBAG

[75] Inventor: Sheldon A. Kopin, Cincinnati, Ohio

[73] Assignee: 'Totes', Incorporated, Loveland, Ohio

[21] Appl. No.: 930,137

[22] Filed: Aug. 2, 1978

[51] Int. Cl.[2] ..... A45C 13/40

[52] U.S. Cl. ..... 150/34; 190/52

[58] Field of Search ..... 150/30, 34, 35; 190/42, 190/52

[56] References Cited

U.S. PATENT DOCUMENTS

| | | | |
|---|---|---|---|
| 2,369,943 | 2/1945 | Broudy | 150/34 |
| 2,394,332 | 2/1946 | Salem | 150/34 |
| 2,495,391 | 1/1950 | Smith | 150/34 UX |

*Primary Examiner*—Donald F. Norton

*Attorney, Agent, or Firm*—Wood, Herron & Evans

[57] ABSTRACT

A handbag having a novel umbrella compartment structure located adjacent the floor of the handbag. The umbrella compartment is comprised of a one-piece generally elongated tubular structure closed at one end, and connected at that one end to the handbag, by the same stitch line that connects the bag's one end wall and the bag's floor. The other end of the tubular compartment is attached to an opening in the bag's other end wall. A flap with an appropriate closure is also attached to that other end wall for opening and closing the umbrella compartment structure during use.

6 Claims, 3 Drawing Figures

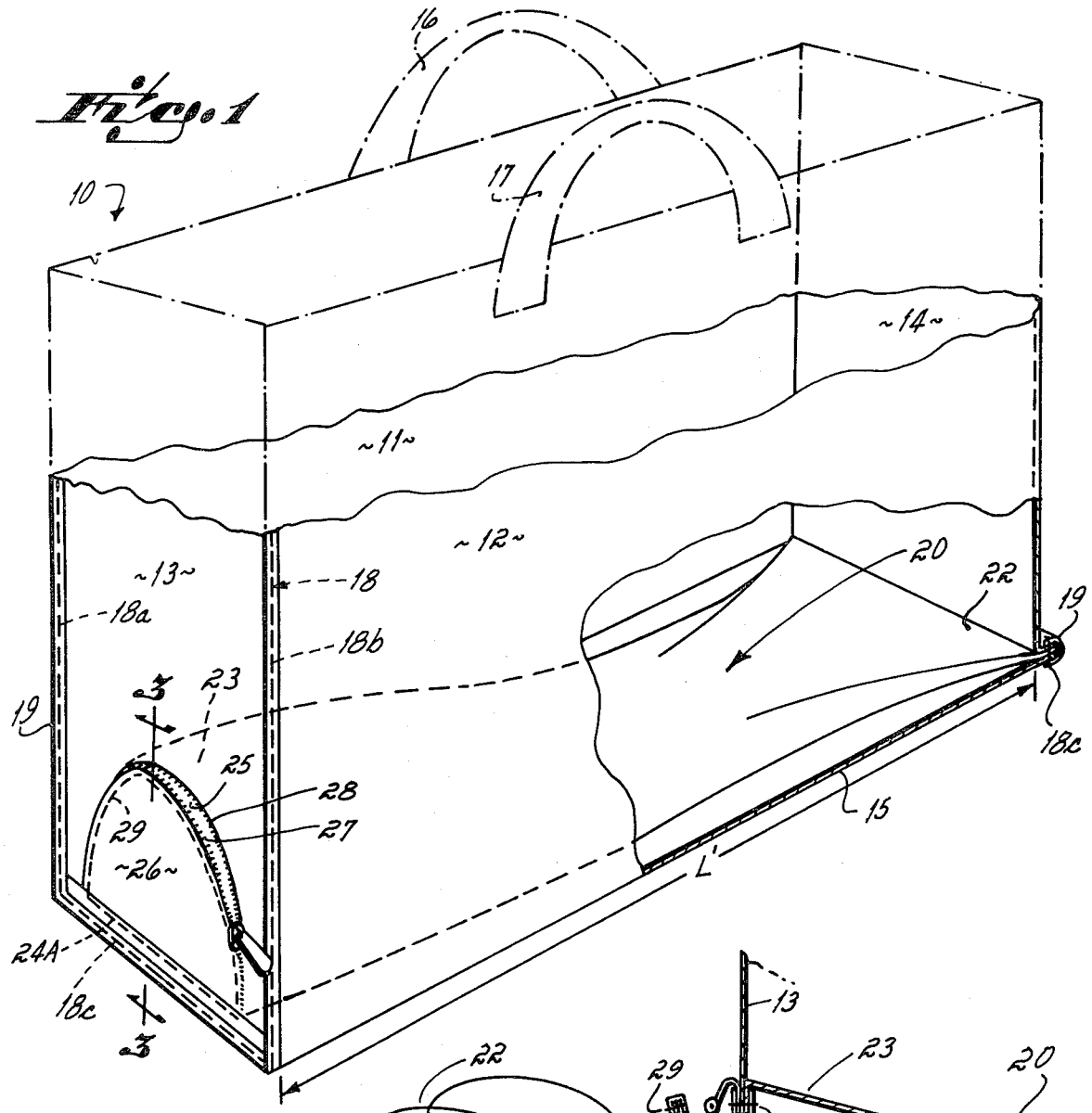
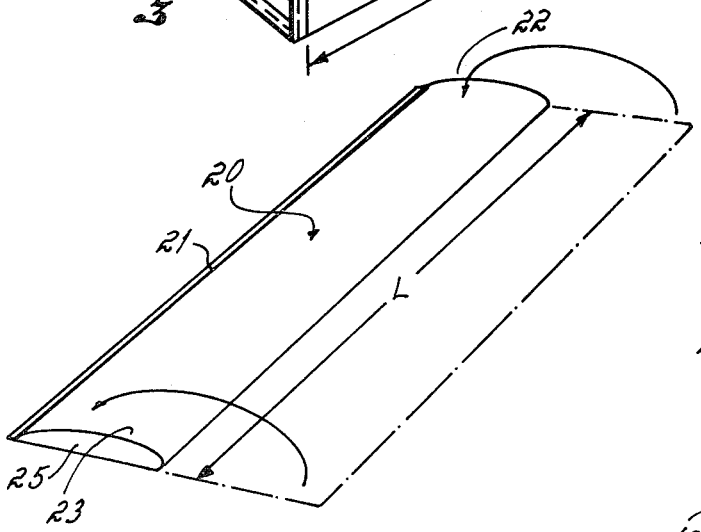
Fig. 2
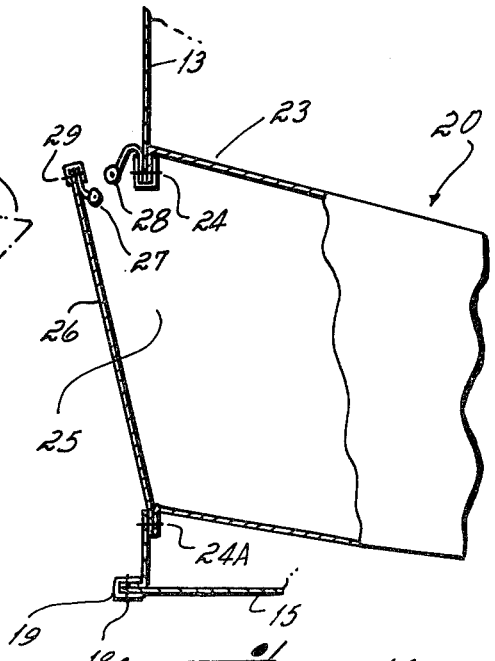
Fig. 3

HANDBAG

This invention relates to handbags. More particularly, this invention relates to a handbag of a type that includes an umbrella compartment.

Handbags are, of course, very well known to the art. Basically, a handbag is comprised of opposed side walls, opposed end walls, and a floor. Normally, handles of some type are attached to each side wall of the bag to permit easy carrying of the bag by the user. Typically, such handbags are used to carry small articles, and are commonly used by women. It is known to the prior art, in handbags of this type, to provide a separate umbrella compartment structure adjacent the floor of the handbag. Typical of such prior art handbag structures, each with an umbrella compartment therein, are those illustrated in Brandy U.S. Pat. No. 2,369,943 and Salem U.S. Pat. No. 2,394,332. In each of these prior art handbags, however, the umbrella compartment structure is relatively difficult to establish adjacent the floor during manufacture of the handbag, thereby causing the finished product to be of a higher cost than may be desirable under current marketing circumstances.

Accordingly, it has been the primary objective of this invention to provide an improved handbag incorporating an umbrella storage compartment adjacent the floor thereof, the umbrella storage compartment being of a simplified construction and easily secured adjacent the floor during fabrication of the handbag. In accord with this objective in preferred form, the improved handbag of this invention includes an umbrella compartment comprised of a one-piece generally elongated tubular structure closed at one end, and connected at that one end to the handbag, by the same stitch line that connects the bag's one end wall the the bag's floor. The other end of the tubular compartment is attached to an opening in the bag's other end wall. A flap with an appropriate closure is also attached to that other end wall for opening and closing the umbrella compartment structure during use.

Other objectives and advantages of this invention will be more apparent from the following detailed description taken in conjunction with the drawings in which:

FIG. 1 is a perspective view, partially broken away, illustrating an improved handbag, in accord with the principles of this invention;

FIG. 2 is a perspective view of the tubular umbrella compartment during fabrication; and FIG. 3 is a cross sectional view taken along line 3—3 of FIG. 1.

A handbag 10 in accord with the principles of this invention is known to the trade as a soft wall bag in that side walls 11, 12, end walls 13, 14 and floor 15 of the bag are made of a soft, flexible material, e.g., canvas. This allows the bag 10 to be easily folded up and stored when not in use. A handle strap 16, 17 is connected to each side wall of the bag to permit easy carrying of the bag by the user. Further, a zipper type closure (not shown) may be provided adjacent the top edges of the opposed side walls 11, 12 to permit the bag 10 to be closed and opened as desired by the user. In this particular embodiment of the bag 10, the end walls 13, 14 are comprised of separate panels, one side wall 11 is comprised of a separate panel, and one side wall 12 and the floor 15 is comprised of another separate panel, the floor being folded relative to the side wall 12 upon assembly.

Hence, and when the bag 10 is viewed in end plan view thereof, it will be seen that a generally U-shaped stitch line 18 connects the end wall 13 or 14, side walls 11, 12 and floor 15 at each end of the handbag. One leg **18*a* of the U-shaped stitch line connects the end wall 13 with side wall 11, another leg 18*b* of the U-shaped stitch line connects end wall 13 with side wall 12, and the base 18*c* of the U-shaped stitch line connects end wall 13 with the floor 15. A strip of seam binding tape 19 is used to present a finished appearance to the bag's wall seams defined by the stich line 18. A tubular umbrella compartment 20 is structurally connected with the soft wall bag 10 adjacent the floor 15 thereof. The tubular umbrella compartment 20 is basically comprised of a single panel rolled into tubular configuration, and retained in that tubular configuration by a heat seal 21** line longitudinally thereof when the panel is fabricated of a heat sealable plastic, see FIG. 2. Preferably this tubular compartment is transparent. The tubular compartment is of a length L adapted to receive a center post collapsible umbrella of any type known to the art. Typical of such a center post collapsible umbrella is that illustrated in U.S. Pat. No. 3,467,115, assigned to the assignee of this application.

The tubular umbrella compartment 20 is closed at one end 22, and is affixed to the bag 10 structure at that one end 22, all by virtue of being stitched to the bag by the bottom leg **18*c* of the U-shaped stitch line 18 at one end wall 14 of the bag, see FIG. 1. In other words, the tubular compartment 20 is closed, and is connected to the bag interiorly thereof, by that same stich line 18*c* that connects the bag's one end wall 14 with the bag's floor 15. This structural connection simplifies initial fabrication or assembly of the handbag. Further, this structural connection allows the length of the tubular umbrella compartment 20 to be effectively the same length as the length L′ of the handbag floor 15 from one end wall 13 to the other end wall 14** of the bag.

The other end 23 of the tubular umbrella compartment 20 is stitched along stitch line 24, 24A to the other end wall 13 of the handbag 10 to define a mount 25 in that end wall for receipt of an umbrella (not shown) therein, see FIGS. 1 and 3. A flap 26 is also stitched along stitch line 24A to that end wall 14 for closing and opening the umbrella compartment 20 as desired by the user. Preferably, a zipper type closure 27, 28 is provided for opening and closing the flap. One half 27 of the zipper type closure is stitched to the flap along stitch line 29. The other half 28 of the zipper type closure is stitched by stitch line 24 to the end wall 13 of the bag, that same stitch line 24 functioning to stitch at least a part of the tubular compartment 20 to the end wall 13 thereof.

Since the tubular compartment 20 is water impermeable, and since the umbrella compartment has no stitch line or other opening thereof into the interior of the handbag (the compartment being sealed longitudinally along heat seal line 21), no water can escape from the umbrella compartment 20 into the handbag's interior when a wet umbrella is stored in the bag. Further, and since the closure flap 26 is in the end wall 13 of the handbag, an umbrella can be inserted into the handbag even when wet without fear of getting water on other contents in the handbag.

Having described in detail the preferred embodiment of my invention, what I desire to claim and protect by Letters Patent is:

1. A handbag comprising opposed side walls, opposed end walls, and a floor, said end walls being stitched to at least one of said side walls and said floor, and an umbrella compartment located adjacent the floor of said handbag, one end of said umbrella compartment opening in a mouth in one end wall of said handbag, and the other end of said compartment being stitched closed, and said other end of said compartment being connected to said handbag, by that same stitch line which connects the other end wall with one of a side wall and said floor.

2. A handbag as set forth in claim 1, said compartment being closed by a stitch line that connects said other end wall and said floor.

3. A handbag as set forth in claim 1, said handbag including a closure flap connected to said one end wall, said closure flap being adapted to open and close the mouth defined in said one end wall.

4. A handbag as set forth in claim 3, said mouth and said closure flap including a zipper type closure having one-half stitched to said flap and one-half stitched to said one end wall, the stitch line serving to stitch that one-half to said one end wall also serving to connect at least a portion of said compartment to said one end wall.

5. A handbag as set forth in claim 1, said compartment being sealed longitudinally, and being of a generally tubular configuration.

6. A handbag as set forth in claim 5, said compartment being fabricated from a generally rectangular sheet material.

* * * * *